US011390429B2

(12) United States Patent
Cristovao

(10) Patent No.: US 11,390,429 B2
(45) Date of Patent: Jul. 19, 2022

(54) CUP LID

(71) Applicant: Rogerio Paulo Vicente Cristovao, Taichung (TW)

(72) Inventor: Rogerio Paulo Vicente Cristovao, Taichung (TW)

( * ) Notice: Subject to any disclaimer, the term of this patent is extended or adjusted under 35 U.S.C. 154(b) by 183 days.

(21) Appl. No.: 16/503,826

(22) Filed: Jul. 5, 2019

(65) Prior Publication Data

US 2021/0002035 A1 Jan. 7, 2021

(51) Int. Cl.

| | |
|---|---|
| ***B65D 43/06*** | (2006.01) |
| ***B65D 43/02*** | (2006.01) |
| *B65D 43/16* | (2006.01) |
| *B65D 81/38* | (2006.01) |

(52) U.S. Cl.

CPC ..... *B65D 43/02* (2013.01); *B65D 43/06* (2013.01); *B65D 43/065* (2013.01); *B65D 43/163* (2013.01); *B65D 43/169* (2013.01); *B65D 81/3876* (2013.01); *B65D 2543/00046* (2013.01); *B65D 2543/00833* (2013.01)

(58) Field of Classification Search

CPC ..... B65D 2543/00833; B65D 43/169; B65D 43/163; B65D 43/065; B65D 43/06; B65D 81/3876; B65D 25/2835; B65D 25/2838; B65D 25/2841; B65D 25/2844; B65D 25/285; B65D 25/2852; B65D 25/2888

See application file for complete search history.

(56) References Cited

U.S. PATENT DOCUMENTS

| | | | | |
|---|---|---|---|---|
| 1,910,168 | A | 5/1933 | Jacobs | |
| 3,285,455 | A * | 11/1966 | Pewitt | A47G 23/0241 215/395 |
| 4,753,358 | A * | 6/1988 | Virca | B01L 3/50825 215/230 |
| 6,761,282 | B1 * | 7/2004 | Anderson | B65D 25/2888 220/754 |
| 7,819,277 | B2 | 10/2010 | Hanson | |
| 9,387,966 | B2 | 7/2016 | Chiang et al. | |
| 2007/0267427 | A1 * | 11/2007 | Yeh | B65D 81/3865 220/772 |
| 2010/0187247 | A1 * | 7/2010 | Ziegler | B65D 25/2817 220/783 |

(Continued)

FOREIGN PATENT DOCUMENTS

| | | | |
|---|---|---|---|
| CN | 202201281 | U | 4/2012 |
| CN | 202429483 | U | 9/2012 |

(Continued)

*Primary Examiner* — Stephen J Castellano

(74) *Attorney, Agent, or Firm* — Kintner IP, LLC; Mary Frances Ludwig

(57) ABSTRACT

A cup lid includes a main body that closely receives a paper cup and a lid connected thereto by a connection section. The lid is arranged to close the paper cup and is attached to the main body. The main body includes a hollow annular body that is provided with a raised ring engagable with a coupling groove of the lid. The main body includes a support section extending from an inner circumference thereof to fix the paper cup therein. The main body is provided, on an outer circumference thereof, with handle sections for holding and lifting by a user and thermal insulation sections positionable on a cup body of the paper cup for thermal isolation and protection against burning when held by the user.

9 Claims, 6 Drawing Sheets

(56) References Cited

U.S. PATENT DOCUMENTS

| | | | | |
|---|---|---|---|---|
| 2011/0192847 | A1* | 8/2011 | Vandamme | B65D 51/20 220/315 |
| 2016/0309935 | A1* | 10/2016 | Chuang | A47G 23/0216 |

FOREIGN PATENT DOCUMENTS

| | | | |
|---|---|---|---|
| TW | 201515951 | A | 5/2015 |
| TW | I650274 | B | 2/2019 |

* cited by examiner

CUP LID

CROSS REFERENCE TO RELATED APPLICATION

None

TECHNICAL FIELD

The present invention relates to a cup lid which functions as a lid for a beverage cup, such as a paper-made cup, and more particularly a cup lid that features thermal insulation and a handle.

BACKGROUND OF THE INVENTION

Hot beverages/liquids that are available in for example, a convenience store, coffee shop, or a beverage shop are often transported in a paper cup and sealed with a plastic cup lid. To prevent the consumer's hands from directly touching the outer surface of the paper cup, a sleeve is often fitted over the outer circumferential surface of the cup. In addition, it is common in certain circumstances that a plastic bag is supplied to hold the beverage cup therein. As a result, in addition to the plastic lids, the materials consumed in making and preparing such a cup of beverage also include the sleeve, the plastic bag, and napkins. These additional materials increase the cost and waste, which is adverse to the current trend of environmental protection.

A hot beverage is often held with a paper cup, while a lid for the cup is often made of plastic. Paper cups are manufactured with significantly large tolerances which often leads to incorrect engagement or disengagement of the plastic lid with the paper cup rim. Most manufactures of paper cups focus on improving the composite structure of paper cups and plastic lids to prevent leaks or spillage. For example, Taiwan Patent I650274, which is owned by the present inventor, discloses a fixing structure of beverage cup lid. Such a fixing structure of a beverage cup lid comprises an annular plate having a width that is generally corresponding, in surface area, to an engagement section of the cup's lid circumference and the surface of the annular plate is fixed to the surface of the cup lid and rim, while the opposite surface is provided with an adhesive layer for bonding to a ridge of an opening of a beverage cup. This provides enhancement of fixing and coupling between the plastic lids and the beverage cup to prevent the beverage from leaking from the interior of the cup through a cup rim to the outside.

Further, U.S. Pat. No. 9,387,966 discloses a lid of a disposable beverage cup. The lid of the disposable beverage cup has at least one drinking hole provided for a consumer to drink the beverage stored in the beverage cup and at least one vent hole provided to maintain the pressure equivalence between the inner side and outer side of the beverage cup. The beverage cup includes at least one drinking hole plug with a peel/plucker or pinch function. The hole plug is arranged to be detachably coupled with the drinking hole to seal and close the drinking hole so as to prevent the beverage from leaking out of the beverage cup.

BRIEF SUMMARY OF THE EMBODIMENTS

There is a need in the art to alleviate the shortcomings and high cost of the aforementioned multiple components commonly used for covering and transporting beverage cups. Embodiments of a cup lid disclosed herein provide multiple features including a double locking lid for a cup, a carrying mechanism, and thermal insulation for easy and safe transport.

The present invention provides a cup lid, which may be a two component or a unitary integrally formed structure, comprising a main body for receiving a paper cup to fit therein and a lid connected thereto with a connection section, the lid being arranged to close a cup opening of the paper cup and attachable to the main body, wherein the main body, which is a flat hollow annular body, is formed with a raised ring corresponding to a coupling groove of the lid and the raised ring is receivable, through fitting, in and coupled with the coupling groove; further, the main body is formed with a support section extending inwards from an inner circumference to provide a feature for clamping and fixing the paper cup that fits within the support section in order to prevent undesired detachment, and is suitable for cups of different sizes; the main body has an outer circumference that is provided, at suitable locations, with handle sections and thermal insulation sections respectively corresponding to each other; the handle sections are formed along the outer circumference and are bent upward to show a generally inverted-U-shape; the two handle sections are arranged so as to receive fingers to hook and lift; the thermal insulation sections are provided along the outer circumference and are bent downward to be positioned on a cup body in order to provide thermal isolation and burning protection when being held.

In embodiments, a connection section has an end connected to an outer circumference of the main body and an opposite end connected to the lid so as to form a unitary, integrally formed structure of the cup lids. The lid is provided, on a surface that closes the paper cup, with an inwardly recessed mounting groove and the mounting groove has a wall that is provided with a raised abutting section, such that the mounting groove is engagable with and coupled to a cup rim of the paper cup and the raised abutting section of the mounting groove fits with the cup rim. The lid is further formed with a coupling groove at a location corresponding to the raised ring of the main body such that the raised ring and the lid are engagable with and thus fixed to each other.

This provides an arrangement that a beverage cup is closeable by a cup lid, such that a lid is fitted to and fixed with a cup rim of the paper cup and, at the same time, a coupling groove of the cup lids is fitted to and fixed with a raised flange of the main body to provide an effect of double securing for the lid. Further, the main body is provided with thermal insulation sections that could replace a conventionally used cup sleeve for hot beverage, and handle sections that allow a user to directly lift without the need of a plastic bag, thereby providing an environmentally friendly option, reducing the cost for cup sleeves and plastic bags, and also featuring thermal isolation and a simple carry bag like function.

These and other aspects of the embodiments will be better appreciated and understood when considered in conjunction with the following description and the accompanying drawings. The following description, while indicating various embodiments and details thereof, is given by way of illustration and not of limitation. Many substitutions, modifications, additions, or rearrangements may be made within the scope of the embodiments, and the embodiments may include all such substitutions, modifications, additions, or rearrangements.

BRIEF DESCRIPTION OF THE DRAWINGS

Non-limiting and non-exhaustive embodiments of the cup lid are described with reference to the following figures, wherein like reference numerals refer to like parts throughout the various views unless otherwise specified.

Figure 1:
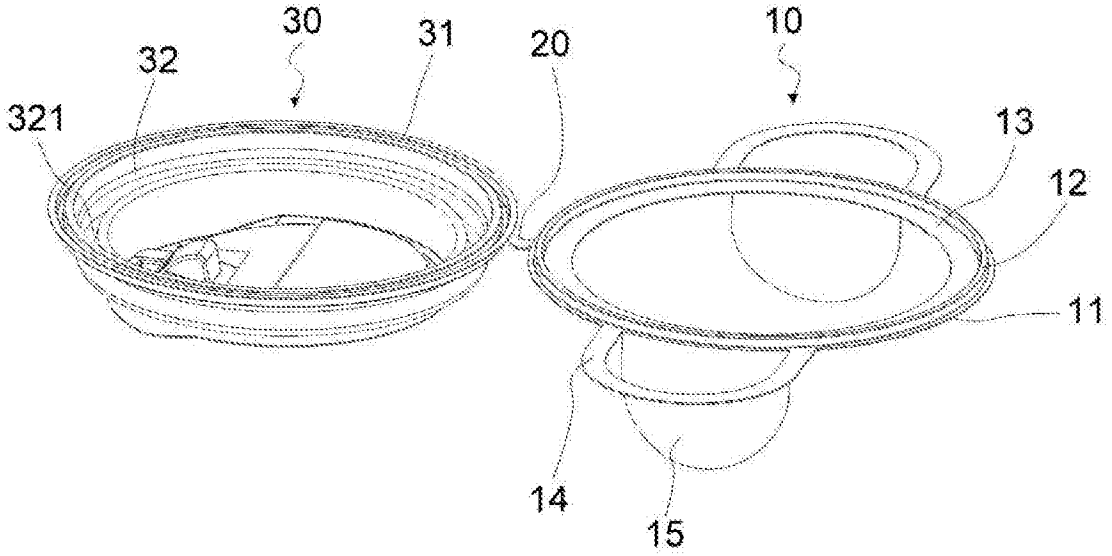
FIG. 1 is a perspective view of an embodiment of a cup lid.
Figure 2:
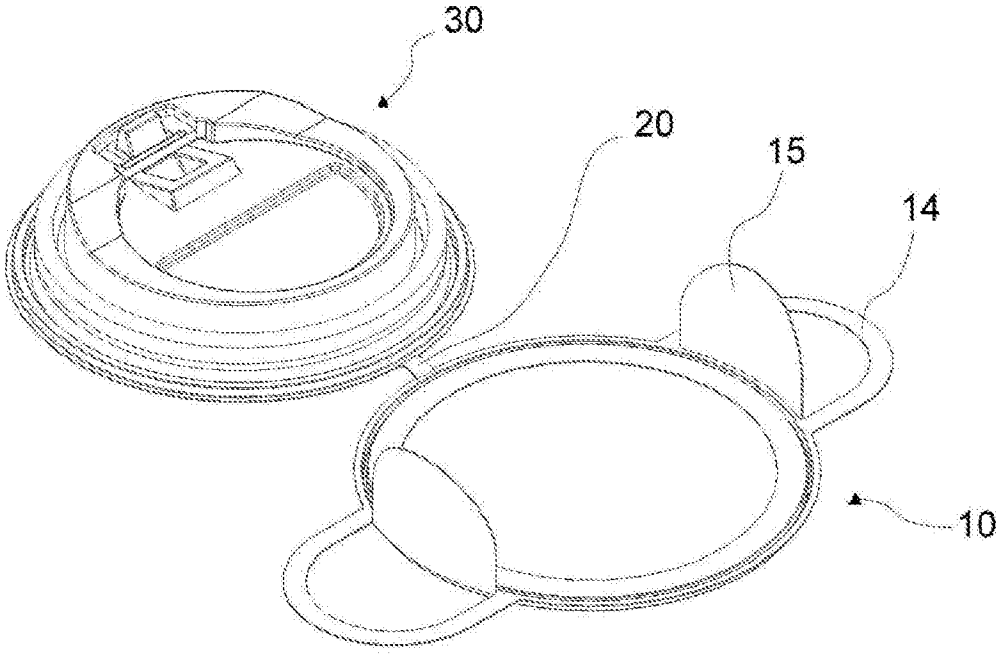
FIG. 2 is an opposing perspective view of the FIG. 1 embodiment.
Figure 3:
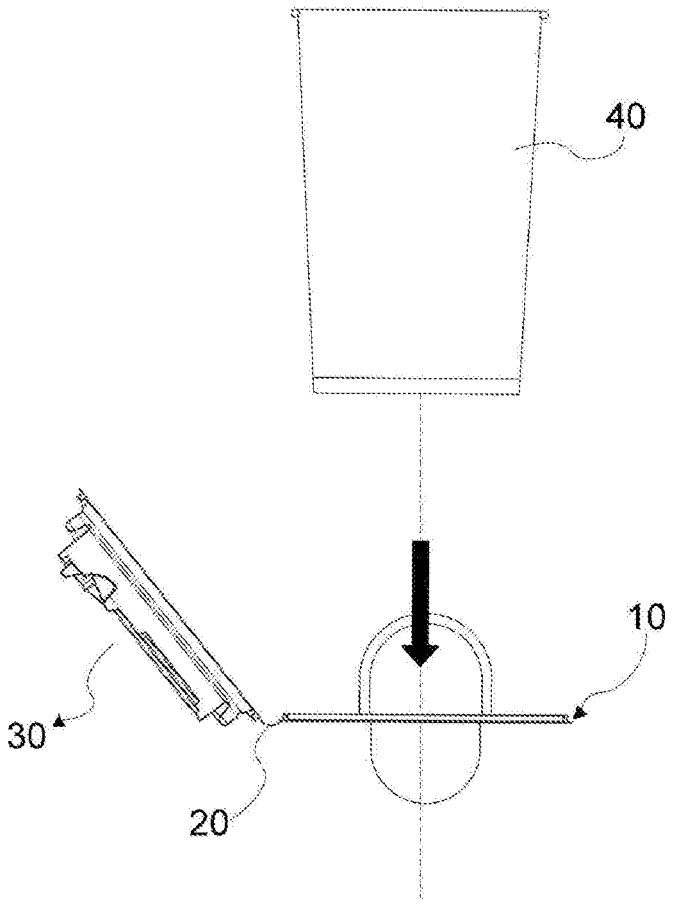
FIG. 3 is a schematic view illustrating an operation of fitting a paper cup with an embodiment of the cup lid.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. Also, common but well-understood elements that are useful or necessary in a commercially feasible embodiment are often not depicted in order to facilitate a less obstructed view of these various embodiments.

DETAILED DESCRIPTION OF THE INVENTION

An embodiment of a cup lid will be described below with reference to FIGS. 1, 2, 3, 4, and 5:

The cup lid is formed integrally as a unitary structure, and comprises a main body 10 that is connected by a connecting section 20 to a lid 30, such that the lid 30 is operable to cover and close a cup opening of a paper cup 40 and is attachable to and thus fixed with the main body 10, wherein a main body 10, which is a flat hollow annular body, is formed with a raised ring 12 corresponding to a coupling groove 31 of the lid 30 and the raised ring 12 is receivable, through fitting, in and coupled with the coupling groove 31; further, the main body 10 is formed with a support section 13 extending inwards from an inner circumference to provide a feature for clamping and fixing the paper cup 40 that is fitted therein by the support section 13 in order to prevent undesired detachment, and is suitable to cups of different sizes. The main body 10 has an outer circumference that is provided, at suitable locations, with handle sections 14 and corresponding thermal insulation sections 15. The handle sections 14 are formed along the outer circumference and are bendable upward to form a generally inverted U-shape. The two handle sections 14 are arranged so as to receive fingers to hook and lift. The thermal insulation sections 15 are provided along the outer circumference and are bent downward so as to be positionable on a cup body in order to provide thermal isolation and protection against burns when being held.

A connection section 20 has an end connected to an outer circumference of a lip 11 of the main body 10 and an opposite end connected to the lid 30 so as to form a unitary, integrally formed structure of the cup lid. A lid 30 is provided, configured to engage a surface that closes the paper cup, with an inwardly recessed mounting groove 32 and the mounting groove 32 has a wall that is provided with a raised abutting section 321, such that the mounting groove 32 is engagable with and coupled to a cup rim 41 of the paper cup 40 and the raised abutting section 321 of the mounting groove 32 is fitted to and thus fixed with the cup rim 41. The lid 30 is further formed with the coupling groove 31 at a location corresponding to the raised ring 12 of the main body 10 such that the raised ring 12 and the coupling groove 31 of the lid 40 are engagable with and thus fixed to each other.

Figure 4:
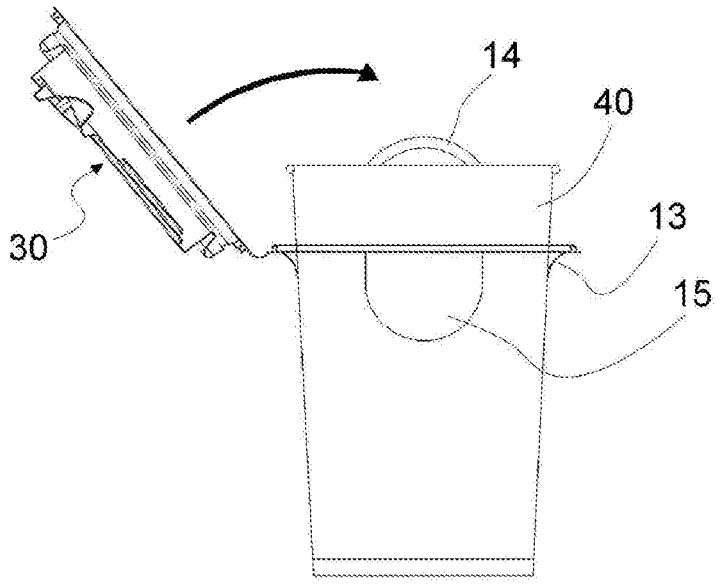
FIG. 4 is a schematic view illustrating an operation of closing an embodiment of the cup lid.
Figure 5:
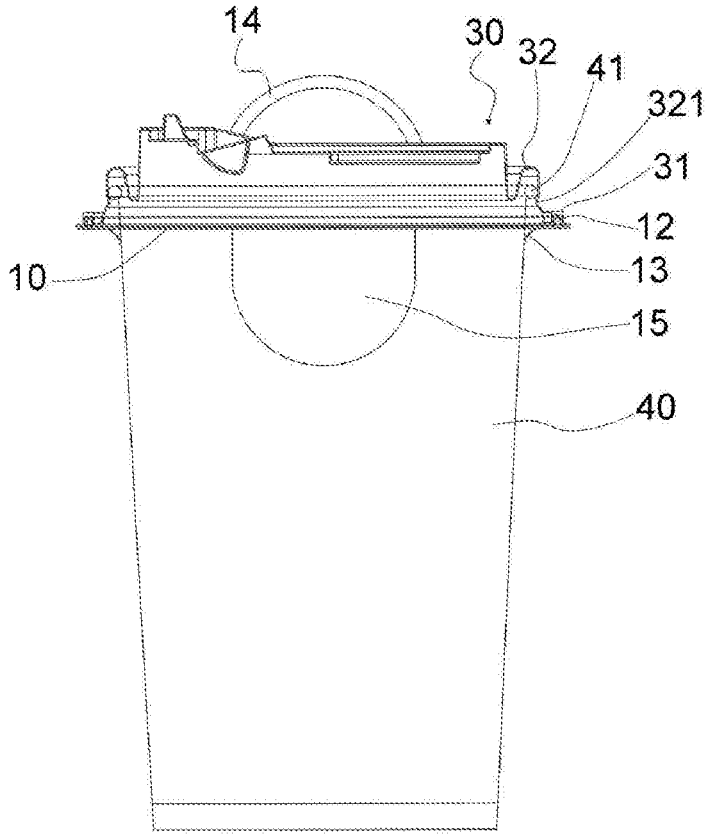
FIG. 5 is a cross-sectional view showing an embodiment of the cup lid in a completely assembled form.

Based on the structure described above, the paper cup 40 that receives and holds a beverage therein first receive the main body 10 to fit to the cup rim 41 of the paper cup 40, such that the support section 13 of the main body 10 is deformed downward to show a curved configuration for applying a force that clamps and fixes the cup body of the paper cup 40 in position (see FIG. 4). Further, the lid 30 is folded upward to cover and close the paper cup 40, such that the mounting groove 32 of the lid 30 is fitted to and engages with the cup rim 41 and the abutting section 321 of the mounting groove 32 is abutting the underside of the cup rim 41. Further, the coupling groove 31 of the lid 30 is set in engagement with and thus fixed with the raised ring 12 to achieve an effect of double fitting and securing by means of the coupling groove 31 and the mounting groove 32 of the lid 30.

Further, the lip 11 of the main body 10 is provided, on each of the suitable locations thereof, with a handle section 14 and a thermal insulation section 15, such that two of such handle sections 14 may serve as a carrying handle for the paper cup 40 that receives a beverage filled therein and thus, there is no need to use an extra plastic bag or a separate container for carrying a beverage cup. Further, corresponding to each of the handle sections 14, one of the thermal insulation sections 15 is provided, such that the thermal insulation section 15 is positionable against a cup body of the paper cup 40 to provide a heat isolation feature when a consumer is holding the cup with a hand and thus, there is no need to provide an extra thermal isolation sleeve to fit over the paper cup 40. Thus, with the arrangement of the handle sections 14 and the thermal insulation sections 15, it is possible to reduce the consumption of package bags and the cup sleeve to thereby achieve the purpose of environmental protection and allowing the beverage suppliers to reduce expenditure and also provide convenience for general use to consumers.

Figure 6:
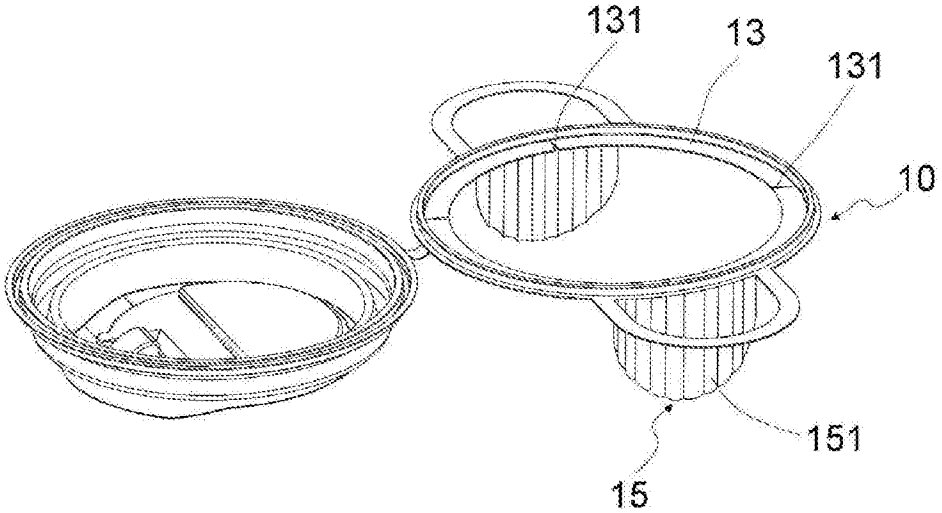
FIG. 6 shows another embodiment of the cup lid.

Further, referring to FIG. 6, a second embodiment of the present invention is shown, wherein the support section 13 of the main body 10 is formed with a plurality of notches 131, and the notches 131 are a feature that could help reduce stress induced in the annular support section 13 when a paper cup 40 is fit therein so as improve clamping and fixing. Further, the thermal insulation section 15 of the main body 10 can be provided with a corrugation 151 in order to reduce a contact area between the thermal insulation section 15 and the paper cup 40 and thus reduce the transfer of heat for better thermal isolation.

The embodiments of the cup lid described herein are exemplary and numerous modifications, combinations, variations, and rearrangements can be readily envisioned to achieve an equivalent result, all of which are intended to be embraced within the scope of the appended claims. Further, nothing in the above-provided discussions of the cup lid should be construed as limiting the invention to a particular embodiment or combination of embodiments. The scope of the invention is defined by the appended claims.

I claim:

1. A cup lid, configured to cooperate with a cup having an open top surrounded by a rim, the cup lid comprising:

a main body, which is an annular body having a raised ring and a lip located on an outer circumference;

a lid having an inwardly recessed mounting groove, the mounting groove having a wall that is provided with a raised abutting section, wherein the mounting groove is dimensioned and configured for engagement with the rim of the cup and the raised abutting section of the mounting groove is configured to abut the cup beneath the rim;

a coupling groove formed in the lid exterior to and concentric with the mounting groove, the coupling groove shaped and dimensioned for close engagement with the raised ring of the main body and configured such the raised ring is receivable into the coupling groove thereby coupling the lid to the main body;

two handle sections extending outwardly from and coplanar with the lip of the main body, unitarily formed with the main body and opposingly arranged on the outer circumference thereof, each of the two handle sections being upwardly bendable to protrude above the lid when the lid and the main body are engaged; and a support section extending inwardly from an inner circumference of the main body, the support section configured to deform downwardly below the main body and contact and retain the cup when the main body is fitted thereon.

2. The cup lid according to claim 1, wherein the support section of the main body is deformable downward to form a curved configuration between the main body and the cup.

3. The cup lid according to claim 1, wherein the support section of the main body is formed with a plurality of notches.

4. The cup lid according to claim 1, wherein the handle section is upwardly bendable to form an inverted-U-shape.

5. The cup lid according to claim 1, wherein the lip has a thermal insulation section positionable to contact the cup when the cup lid is fitted thereto.

6. The cup lid according to claim 5, wherein the thermal insulation section is downwardly bendable to contact the cup.

7. The cup lid according to claim 5, wherein the thermal insulation section of the main body is formed with a corrugated structure.

8. The cup lid according to claim 1, wherein the main body is connected to the lid with a connection section arranged there between, thereby forming a unitary, integrally formed structure of the cup lid.

9. A cup lid, configured to cooperate with a cup having an open top surrounded by a rim, the cup lid comprising:

a main body, which is an annular body having a raised ring and a lip located on an outer circumference;

a lid having an inwardly recessed mounting groove, the mounting groove having a wall that is provided with a raised abutting section, wherein the mounting groove is dimensioned and configured for engagement with the rim of the cup and the raised abutting section of the mounting groove is configured to abut the cup beneath the rim;

a coupling groove formed in the lid exterior to and concentric with the mounting groove, the coupling groove shaped and dimensioned for close engagement with the raised ring of the main body and configured such the raised ring is receivable into the coupling groove thereby coupling the lid to the main body;

two handle sections extending outwardly from and coplanar with the lip of the main body, unitarily formed with the main body and opposingly arranged on the outer circumference thereof, each of the two handle sections being upwardly bendable to protrude above the lid when the lid and the main body are engaged; and a thermal insulation section extending outwardly from the lip of the main body, the thermal insulation section being downwardly bendable and configured to contact the cup.

* * * * *